US008903101B2

(12) United States Patent
Christoph et al.

(10) Patent No.: US 8,903,101 B2
(45) Date of Patent: Dec. 2, 2014

(54) ACTIVE NOISE REDUCTION SYSTEM

(75) Inventors: Markus Christoph, Straubing (DE); Michael Wurm, Straubing (DE); Michael Perkmann, Vienna (AT)

(73) Assignee: Harman Becker Automotive Systems GmbH, Karlsbad (DE)

( * ) Notice: Subject to any disclaimer, the term of this patent is extended or adjusted under 35 U.S.C. 154(b) by 689 days.

(21) Appl. No.: 13/035,393

(22) Filed: Feb. 25, 2011

(65) Prior Publication Data

US 2011/0206214 A1 Aug. 25, 2011

(30) Foreign Application Priority Data

Feb. 25, 2010 (EP) ..... 10154629

(51) Int. Cl.
*G10K 11/16* (2006.01)
*G10K 11/178* (2006.01)

(52) U.S. Cl.
CPC .... *G10K 11/1784* (2013.01); *G10K 2210/3055* (2013.01); *G10K 2210/1081* (2013.01)
USPC ..... 381/71.6; 381/71.8; 381/71.11; 381/79; 381/97; 455/501; 455/570; 379/406.01

(58) Field of Classification Search
CPC ..... H04R 3/002; H04R 3/005; H04R 3/02; H04R 1/04; H04R 1/10; H04R 1/1008; H04R 1/1016; H04R 1/1041; H04R 1/1083; H04R 1/1091; H04R 1/2873; H04R 5/033; H04R 5/0335; H04R 25/02; H04R 25/04; H04R 25/30; H04R 25/305; H04R 25/45; H04R 25/453; H04R 25/48; H04R 25/556; H04R 25/608; H04R 2201/10; H04R 2205/022; H04R 2209/024; H04R 2225/49; H04R 2227/009; H04R 2410/01; H04R 2410/03; H04R 2410/05; H04R 2410/07; H04R 2420/07; H04R 2460/01; H04R 2460/11; H04M 9/082; H04M 1/68; H04M 3/002; H04M 3/26; H04M 9/08; H04M 9/085; H04M 9/087; H04B 3/20; H04B 3/23; H04B 3/231234; H04B 3/232; H04B 3/235; H04B 3/237; H04B 3/238; H04B 3/32; H04B 3/34; H04B 3/464; H04B 3/468; H04B 15/005; H04B 15/02; H04B 15/04; H04B 15/06; G10L 21/0205; G10L 21/0208; G10L 21/0216; G10L 21/0224; G10L 21/0232; G10L 21/0264; G10L 21/0308
USPC ..... 381/71.1, 71.2, 71.5, 71.6, 71.7, 71.8, 381/71.9, 71.11, 71.12, 72, 73.1, 74, 77, 79, 381/93, 94.1, 94.7, 94.9, 95, 96, 97, 98, 381/100, 103, 119, 122, 66; 455/501, 63.1, 455/570, 114.3, 135; 379/406.01, 406.05, 379/405.06, 406.08, 406.09, 406.13, 379/406.14; 700/94
See application file for complete search history.

(56) References Cited

U.S. PATENT DOCUMENTS

| | | | | |
|---|---|---|---|---|
| 4,494,074 | A | 1/1985 | Bose | |
| 6,735,316 | B1 * | 5/2004 | Wurtz | 381/74 |
| 8,422,691 | B2 | 4/2013 | Asada et al. | |
| 2003/0095670 | A1 | 5/2003 | Wurtz | |
| 2008/0107282 | A1 | 5/2008 | Asada | |
| 2008/0112569 | A1 | 5/2008 | Asada | |
| 2008/0112570 | A1 | 5/2008 | Asada et al. | |
| 2008/0159555 | A1 | 7/2008 | Asada et al. | |
| 2008/0181422 | A1 * | 7/2008 | Christoph | 381/73.1 |
| 2009/0086988 | A1 | 4/2009 | Ou et al. | |

FOREIGN PATENT DOCUMENTS

| | | |
|---|---|---|
| CN | 2765416 | 3/2006 |
| DE | 102007001980 | 7/2008 |
| GB | 2270441 | 3/1994 |
| JP | 2002-224500 | 9/1990 |
| JP | 2001-142469 | 5/2001 |
| WO | 2008029336 | 3/2008 |

OTHER PUBLICATIONS

Kuo et al., "Active Noise Control: A Tutorial Review", Proceedings of the IEEE, vol. 87, No. 6, Jun. 1999.

Chinese Office Action.
Japanese Office Action dated Apr. 2, 2014.
Canadian Office Action.

* cited by examiner

*Primary Examiner* — Leshui Zhang
(74) *Attorney, Agent, or Firm* — O'Shea Getz P.C.

(57) ABSTRACT

A system for actively reducing noise at a listening point, includes an earphone housing, a transmitting transducer, a receiving transducer and a controller. The transmitting transducer converts a first electric signal into a first acoustic signal, and radiates the first acoustic signal along a first acoustic path having a first transfer characteristic and along a second acoustic path having a second transfer characteristic. The receiving transducer converts the first acoustic signal and ambient noise into a second electrical signal. The controller compensates for the ambient noise by providing a noise reducing electrical signal to the transmitting transducer. The noise reducing electrical signal is derived from a filtered electrical signal that is provided by filtering the second electrical signal with a third transfer characteristic. The second and the third transfer characteristics together model the first transfer characteristic.

19 Claims, 7 Drawing Sheets

ACTIVE NOISE REDUCTION SYSTEM

CLAIM OF PRIORITY

This patent application claims priority from EP application no. 10 154 629.9 filed Feb. 25, 2010, which is hereby incorporated by reference.

FIELD OF TECHNOLOGY

This invention relates generally to noise reduction and, more particularly, to active noise reduction in headphones.

RELATED ART

A set of headphones may include an active noise reduction system, also known as an active noise cancelling (ANC) system. Generally, such a noise reduction system may be classified as a feedback noise reduction system or a feedforward noise reduction system.

A feedback noise reduction system typically includes a microphone, an acoustic tube and a speaker. The microphone is positioned in the acoustic tube, which may be attached to the ear of a user. The speaker is positioned between the microphone and a noise source. External noise from the noise source is collected by the microphone within the acoustic tube, and is inverted in phase and emitted from the speaker to reduce the external noise.

A feedforward noise reduction system typically includes a first microphone, a second microphone, an acoustic tube and a speaker. The first microphone is positioned in the acoustic tube between the speaker and an auditory meatus, i.e., in the proximity of the ear. The second microphone is positioned between a noise source and the speaker, and is used to collect external sound. The output of the second microphone is used to make a transmission characteristic of a path from the first microphone to the speaker the same as a transmission characteristic of a path along which the external noise reaches the meatus. The speaker is positioned between the first microphone and the noise source. External noise from the noise source is collected by the first microphone, and is inverted in phase and emitted from the speaker to reduce the external noise.

The microphones in both feedback and feedforward noise reduction systems are typically arranged in front of the speakers and close to the user's ear. Such an arrangement, however, may be uncomfortable for the user. In addition, the microphones have little mechanical protection and therefore are susceptible to serious damage during use.

SUMMARY OF THE INVENTION

According to a first aspect of the invention, an active noise reduction system includes an earphone, a first acoustic path, a second acoustic path and a control unit. The earphone includes a cupped housing, a transmitting transducer and a receiving transducer. The transmitting transducer converts a first electrical signal into a first acoustical signal, and radiates the first acoustical signal to the ear. The transmitting transducer is arranged at an aperture of the cupped housing thereby defining an earphone cavity. The receiving transducer converts a second acoustical signal into a second electrical signal. The receiving transducer is arranged within the earphone cavity. The first acoustical path extends from the transmitting transducer to the ear, and has a first transfer characteristic. The second acoustical path extends from the transmitting transducer to the receiving transducer, and has a second transfer characteristic. The control unit communicates with the receiving transducer and the transmitting transducer. The control unit compensates for ambient noise by generating a noise reducing electrical signal that is supplied to the transmitting transducer. The noise reducing electrical signal is derived from a filtered electrical signal, which is provided by filtering the second electrical signal with a third transfer characteristic. The second and the third transfer characteristics together model the first transfer characteristic.

According to a second aspect of the invention, a system for actively reducing noise at a listening point (e.g., within an ear of a user) includes a cupped earphone housing, a transmitting transducer, a receiving transducer, and a controller. The cupped earphone housing has an earphone aperture and an inner earphone cavity. The transmitting transducer is positioned at the earphone aperture. The transmitting transducer converts a first electric signal into a first acoustic signal, and radiates the first acoustic signal along a first acoustic path having a first transfer characteristic and along a second acoustic path having a second transfer characteristic. The receiving transducer is positioned within the earphone cavity. The receiving transducer converts the first acoustic signal and ambient noise into a second electrical signal. The controller compensates for the ambient noise by providing a noise reducing electrical signal to the transmitting transducer. The noise reducing electrical signal is derived from a filtered electrical signal that is provided by filtering the second electrical signal with a third transfer characteristic. The first acoustic path extends from the transmitting transducer to the listening point. The second acoustic path extends from the transmitting transducer to the receiving transducer. The second and the third transfer characteristics together model the first transfer characteristic.

DESCRIPTION OF THE DRAWINGS

Various embodiments of the active noise reduction system are described below with reference to the following figures. Unless stated otherwise, identical components are labeled in the figures with the same reference numbers. In the drawings.

DETAILED DESCRIPTION OF THE INVENTION

Figure 1:
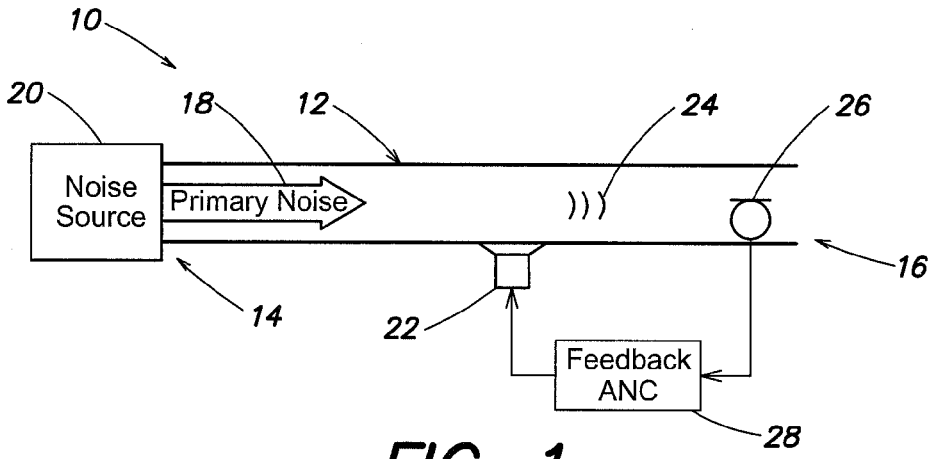
FIG. 1 (Prior Art)
FIG. 1 is an illustration of a known feedback active noise reduction system.

FIG. 1 illustrates a known feedback type active noise reduction system 10. The noise reduction system 10 includes an acoustic tube 12 that extends between a first end 14 and a second end 16. Primary noise 18 (e.g., ambient noise) from a noise source 20 is introduced into the tube 12 through the first end 14. Sound waves of the primary noise 18 travel through the tube 12 to the second end 16. The sound waves may radiate from the second end 16, for example, into an ear of a user when the tube is attached to the head of the user. A speaker 22 (e.g. a loudspeaker) may introduce cancelling sound 24 into the tube 12 to reduce or cancel the primary noise 18. Amplitude of the cancelling sound 24 at least corresponds to or is the same as amplitude of the primary noise 18. The cancelling sound 24, however, has an opposite phase to that of the primary noise 18. The primary noise 18 is collected by an error microphone 26. A feedback ANC processing unit 28 inverts the collected primary noise 18 in phase, which is then emitted from the loudspeaker 22 to reduce the primary noise 18. The error microphone 26 is arranged downstream of the loudspeaker 22 and, thus, is closer to the second end 16 of the tube 12 and the ear of the user than to the loudspeaker 22.

Figure 2:
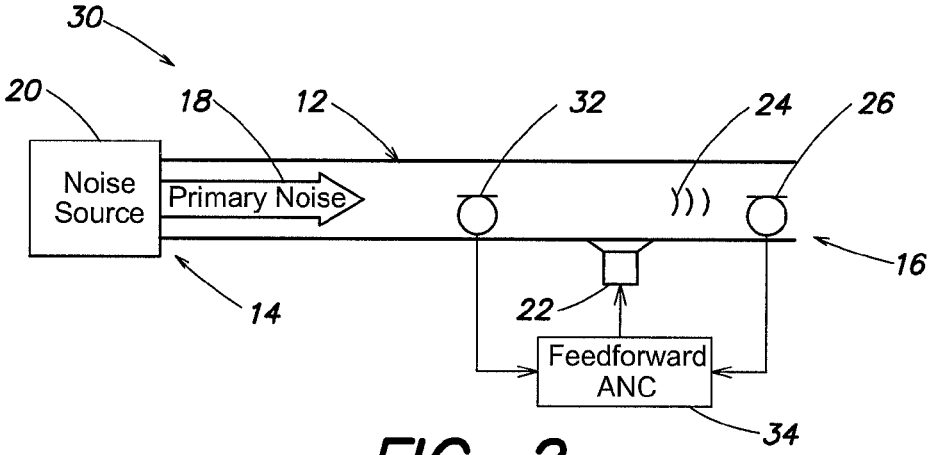
FIG. 2 (Prior Art)
FIG. 2 is an illustration of a known feedforward noise reduction system.

FIG. 2 illustrates a known feedforward type active noise reduction system 30. The noise reduction system 30 includes, in contrast to the noise reduction system 10, an additional reference microphone 32. The reference microphone 32 is positioned between the noise source 20 and the loudspeaker 22. The noise reduction system 30 further includes a feedforward ANC processing unit 34, rather than the feedback ANC processing unit 28. The reference microphone 32 collects the primary noise 18. The output of the reference microphone 32 is used to adapt a transmission characteristic of a path from the loudspeaker 22 to the error microphone 26 such that the transmission characteristic matches a transmission characteristic of a path along which the primary noise 18 reaches the second end 16 of the tube 12, i.e., the user's ear (not shown). The collected primary noise 12 is inverted in phase using the adapted transmission characteristic of the signal path from the loudspeaker 22 to the error microphone 26, and emitted from the loudspeaker 22 arranged between the two microphones 26 and 32 to reduce the external noise. The signal inversion and the transmission path adaptation are performed by the feedforward ANC processing unit 34.

Figure 3:
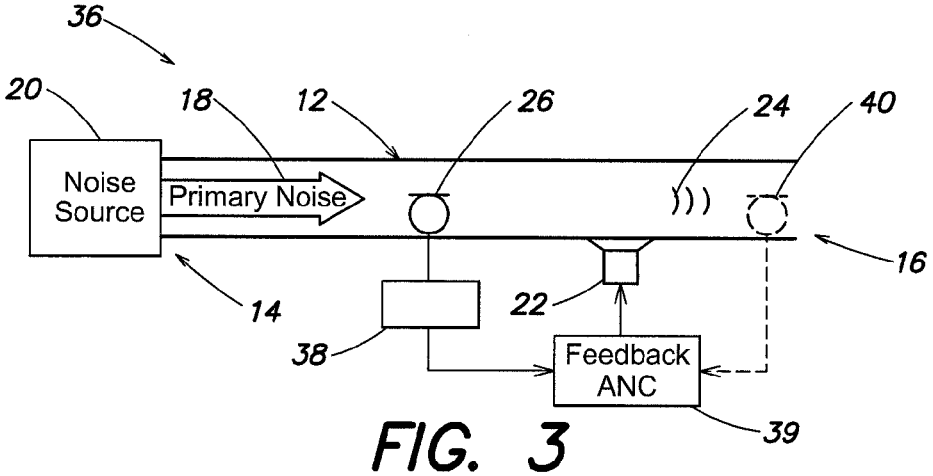
FIG. 3 is an illustration of a feedback active noise reduction system.

FIG. 3 illustrates an embodiment of a feedback active noise reduction system 36. In contrast to the noise reduction system 10 shown in FIG. 1, is the error microphone 26 included in the noise reduction system 36 is positioned between the first end 14 of the tube 12 and the loudspeaker 22. The noise reduction system 36 also includes a filter 38 connected between the error microphone 26 and a feedback ANC processing unit 39. The filter 38 is adapted such that the microphone 26 is virtually located downstream of the loudspeaker 22 (i.e., between the loudspeaker 22 and the second end 16 of the tube 12) modeling a virtual error microphone 40.

Figure 4:
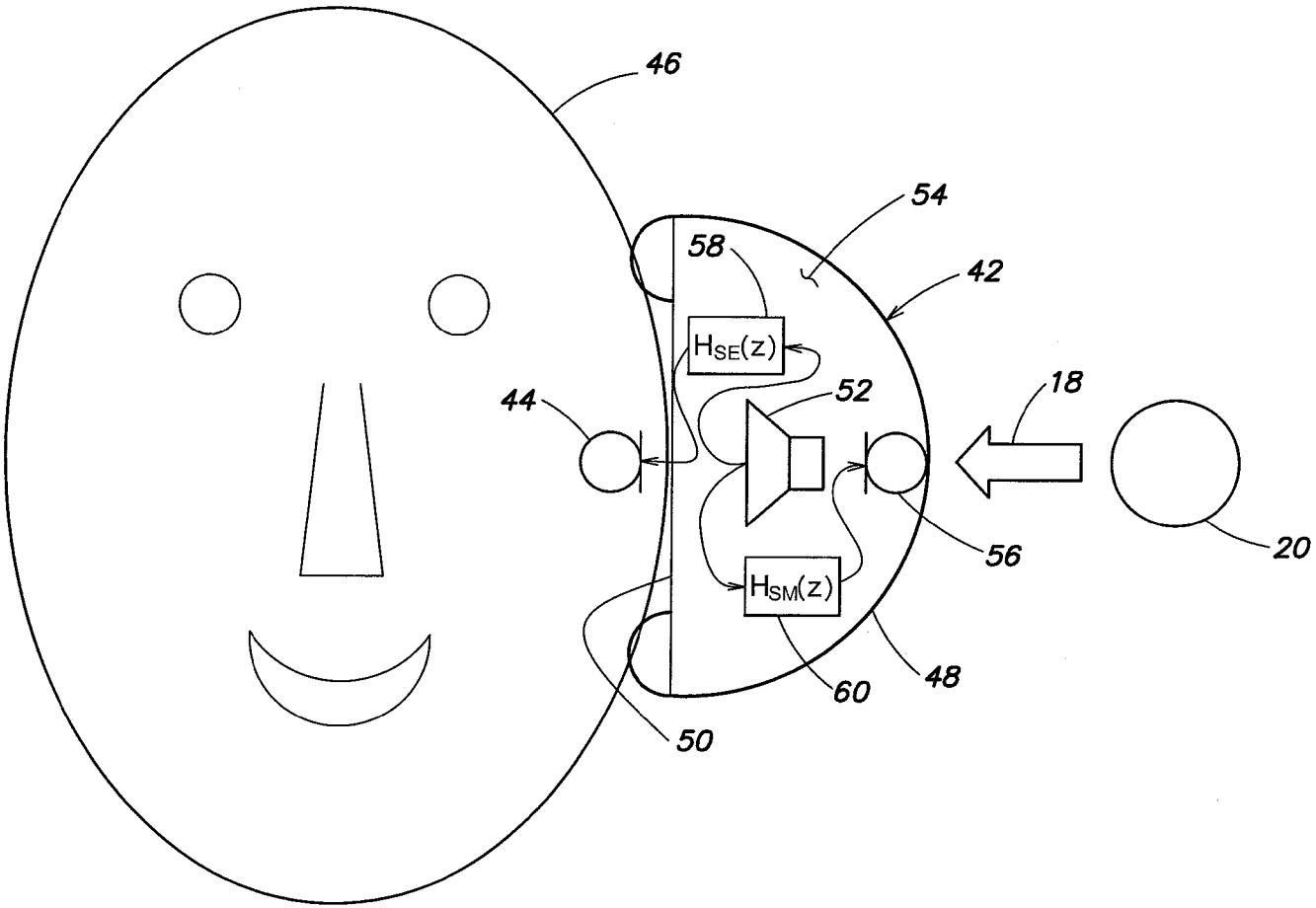
FIG. 4 is an illustration of an active noise reduction system configured with an earphone.

FIG. 4 illustrates an earphone 42 included in an embodiment of the active noise reduction system. The earphone 42 may be included in a set of headphones (not shown), and may be acoustically coupled to an ear 44 of a user 46. The ear 44 may be exposed to ambient noise that forms the primary noise 18 originating from noise source 20. The earphone 42 includes a cupped housing 48 with an aperture 50. The aperture 50 may be covered by a grill, a grid or any other sound permeable structure or material.

A transmitting transducer 52 (e.g., a speaker) that converts electrical signals into acoustical signals to be radiated to the ear 44 is positioned at the aperture 50 of the housing 48 thereby forming an earphone cavity 54. The speaker 52 may be hermetically mounted to the housing 48 to provide an air tight cavity 54, i.e., to create a hermetically sealed volume (not shown). Alternatively, the cavity 54 may be vented as shown in FIG. 4.

A receiving transducer 56 (e.g., an error microphone) that converts acoustical signals into electrical signals is positioned within the earphone cavity 54. The error microphone 56 therefore is positioned between the speaker 52 and the noise source 20. An acoustical path 58 extends from the speaker 52 to the ear 44 and has a transfer characteristic of $H_{SE}(z)$. An acoustical path 60 extends from the speaker 52 to the error microphone 56 and has a transfer characteristic of $H_{SM}(z)$.

Figure 5:
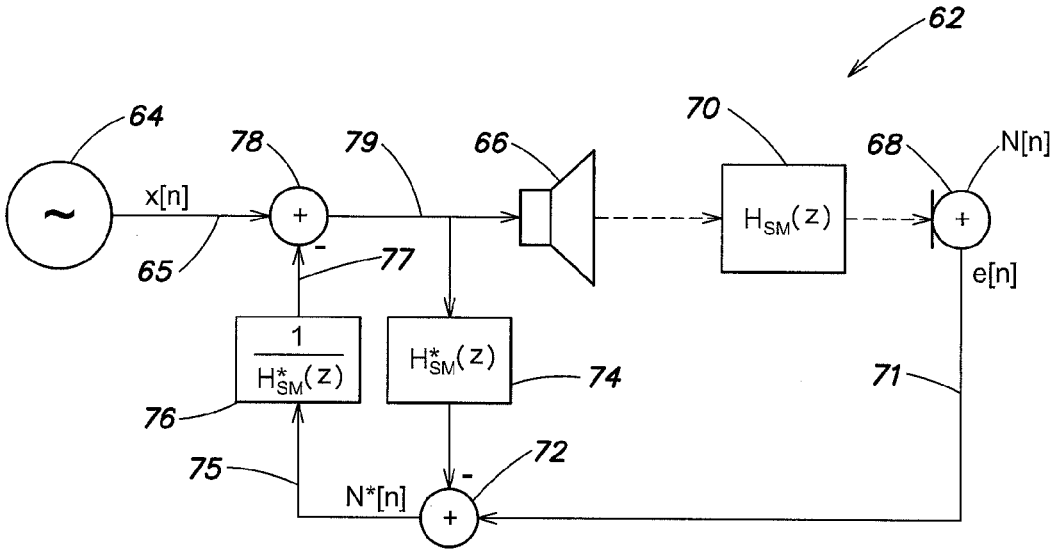
FIG. 5 (Prior Art)
FIG. 5 is a signal flow for a known active noise reduction system.

FIG. 5 illustrates a signal flow for a known active noise reduction system 62 (e.g., the noise reduction system 10 in FIG. 1). The noise reduction system 62 includes a signal source 64 for providing a source signal x[n] on line 65 to be acoustically radiated by a speaker 66. The speaker 66 also operates as a cancelling loudspeaker (e.g., the loudspeaker 22 in FIG. 1). The sound radiated by speaker 66 is transferred to an error microphone 68 (e.g., the microphone 26 in FIG. 1) via a secondary path 70 having the transfer characteristic $H_{SM}(z)$.

The microphone 68 receives the sound radiated from the speaker 66 and noise N[n] (e.g., ambient noise) from a noise source (not shown), and generates an electrical signal e[n] therefrom. The signal e[n] is supplied on line 71 to a subtractor 72 that subtracts an output signal of a filter 74 from the signal e[n] to generate a signal N*[n]. The signal N*[n] is an electrical representation of the noise N[n]. The filter 74 has a transfer characteristic of $H^*_{SM}(z)$, which is an estimate of the transfer characteristic $H_{SM}(z)$ of the secondary path 70. The signal N* [n] is output on line 75 and filtered by filter 76, which has a transfer characteristic substantially equal to the inverse of transfer characteristic $H^*_{SM}(z)$. The output of the filter 76 is supplied via line 77 to a subtractor 78, which subtracts the output signal of the filter 76 from the source signal x[n] on line 65 to generate a signal to be supplied to the speaker 66 via line 79. The filter 74 is supplied with the same signal as the speaker 66 via the line 79. The noise reduction system 62 shown in FIG. 5 therefore has a so-called closed-loop structure.

Figure 6:
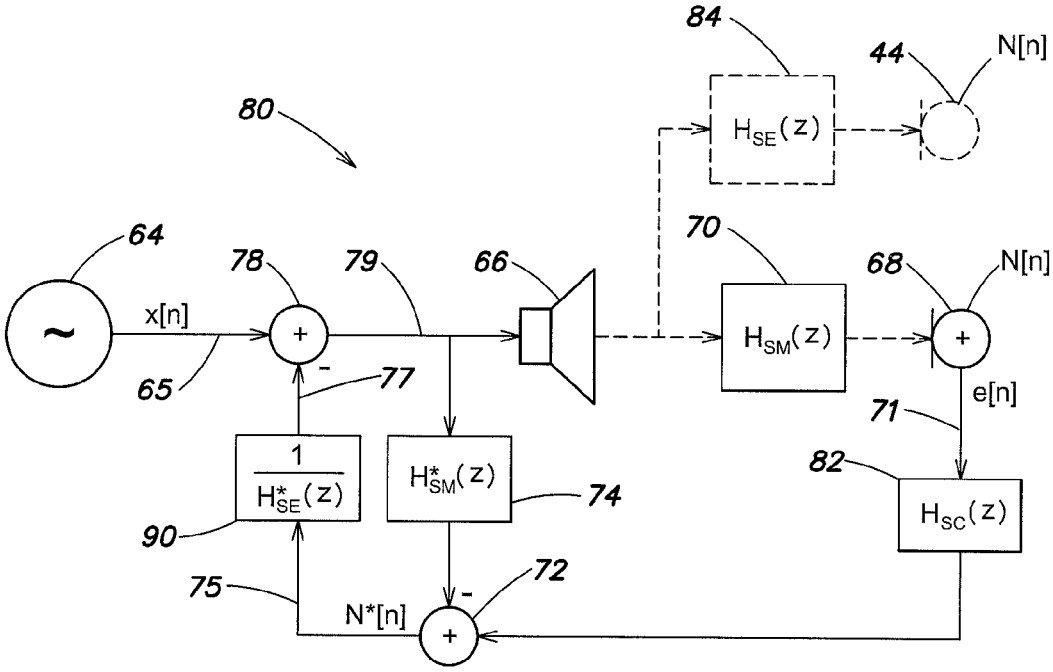
FIG. 6 is a block diagram illustration of an active noise reduction system having a closed-loop structure.

FIG. 6 illustrates a signal flow of an embodiment of a closed-loop active noise reduction system 80. The noise reduction system 80 includes an additional filter 82 having a transfer characteristic $H_{SC}(z)$. The filter 82 is connected between the error microphone 68 and the subtractor 72. The transfer characteristic $H_{SC}(z)$ may be expressed as follows:

$$H_{SC}(z)=H_{SE}(z)-H_{SC}(z).$$

The transfer characteristics $H_{SM}(z)$ of the secondary path 70 and the transfer characteristic $H_{SC}(z)$ of the filter 82 therefore together model the transfer characteristic $H_{SE}(z)$ of a virtual signal path 84 between the speaker 66 and a virtual microphone (e.g., the user's ear 44) at a desired signal position (listening position). When applying the aforesaid transfer characteristics, for example, to the system in FIG. 4, the microphone 56 may be virtually shifted from its real position between the noise source 20 and the speaker 52 to a virtual position at the user's ear (shown as the ear microphone 44 in FIG. 4).

Referring to the noise reduction system 36 in FIG. 3, the virtual signal path extends from the loudspeaker 22 to the virtual microphone 40. The physical signal path extends from the microphone 26 to the loudspeaker 22. The position of the real microphone 26 may be virtually shifted to the position of microphone 40 using the filter 82, which is downstream of the microphone 26.

Figure 7:
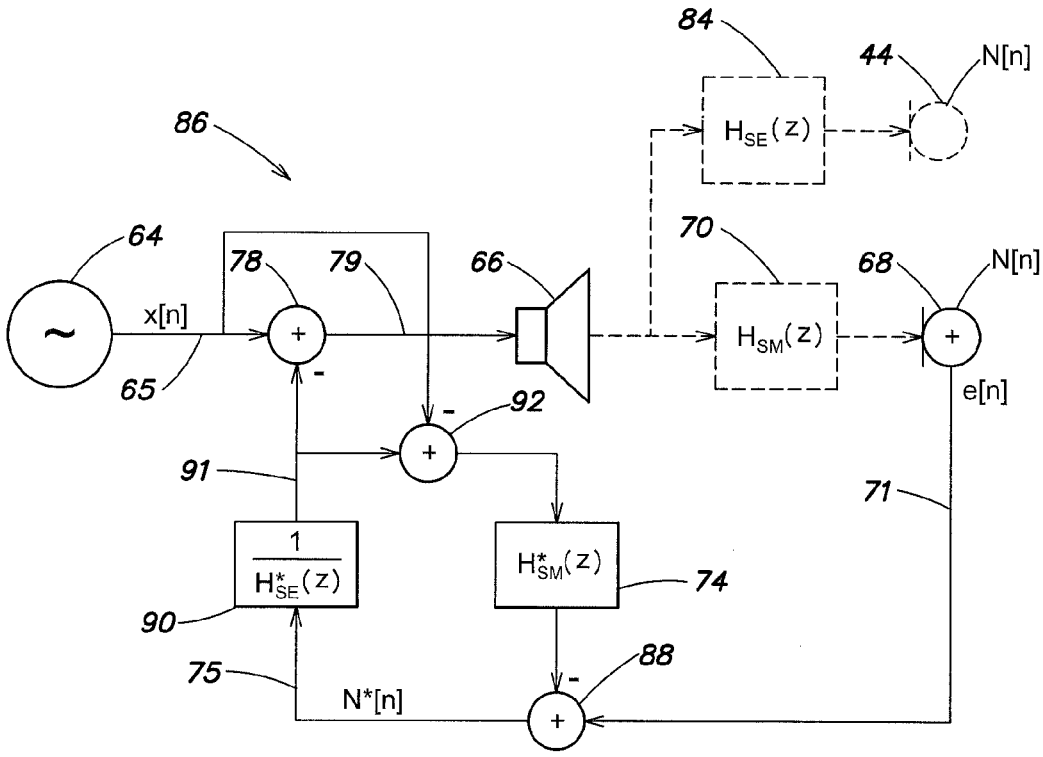
FIG. 7 is a block diagram illustration of a signal flow of an alternative embodiment active noise reduction system having a closed-loop structure.

FIG. 7 illustrates a signal flow in an alternative embodiment of a closed-loop active noise reduction system 86. The signal source 64 supplies the source signal x[n] via the line 65 to the speaker 66, which acoustically radiates the signal x[n] and actively reduces noise. The sound radiated by the speaker 66 propagates to the error microphone 68 via the secondary path 70 having the transfer characteristic $H_{SM}(z)$.

The microphone 68 receives the sound from the speaker 66 and the noise N[n], and generates the electrical signal e[n] therefrom. Signal e[n] is supplied via the line 71 to an adder 88 that adds the output signal of filter 74 to the signal e[n] to generate the signal N*[n]. The signal N*[n] on the line 75 may be an electrical representation of noise N[n]. The filter 74 has the transfer characteristic $H^*_{SM}(z)$ that corresponds to the transfer characteristic $H_{SM}(z)$ of the secondary path 70. The signal N* [n] is filtered by a filter 90, which has a transfer characteristic substantially equal to the inverse of transfer characteristic $H_{SE}(z)$. The output of the filter 90 is supplied via line 91 to the subtractor 78. The subtractor 78 subtracts the output signal of the filter 90 from the source signal x[n] to generate a signal to be supplied via the line 79 to the speaker 66. The filter 74 is supplied with an output signal of a subtractor 92 that subtracts the signal x[n] on the line 65 from the output signal of filter 90 on the line 91.

Figure 8:
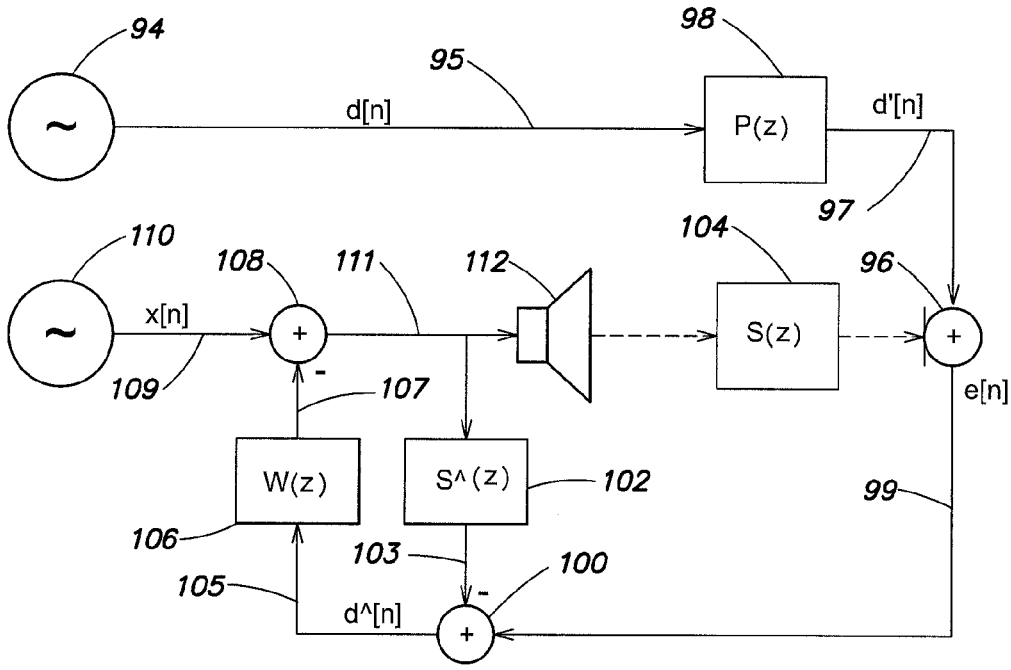
FIG. 8 is a block diagram illustration of the active noise reduction system shown in FIG. 7.

FIG. 8 is a schematic illustration of the noise reduction system shown in FIG. 7. A noise source 94 provides a noise signal d[n] via line 95 to an error microphone 96 via a primary transmission path 98. The primary transmission path 98 has a transfer characteristic P(z), and provides a noise signal d'[n] via line 97 to the error microphone 96.

The error signal e[n] is supplied via line 99 to an adder 100. The adder 100 subtracts an output signal on line 103 of a filter 102 from the signal e[n] on the line 99 to generate a signal d^[n]. The signal d^[n] on line 105 is an estimated representation of the noise signal d'[n] on line 97. The filter 102 has a transfer characteristic S^(z), which is an estimation of the transfer characteristic S(z) of the secondary path 104. The signal d^[n] on the line 105 is filtered by a filter 106 having a transfer characteristic W(z). The output of the filter 106 is supplied via line 107 to a subtractor 108. The subtractor 108 subtracts the output signal on the line 107 from the source signal x[n] (e.g., music or speech) on line 109, which is supplied by a signal source 110, to generate a signal to be supplied to the speaker 112 on line 111. The speaker 112 transmits the signal on line 111 to the error microphone 96 via a secondary transmission path 104, which has a transfer characteristic S(z). The filter 102 receives the output signal from the subtractor 108 on the line 111.

Figure 9:
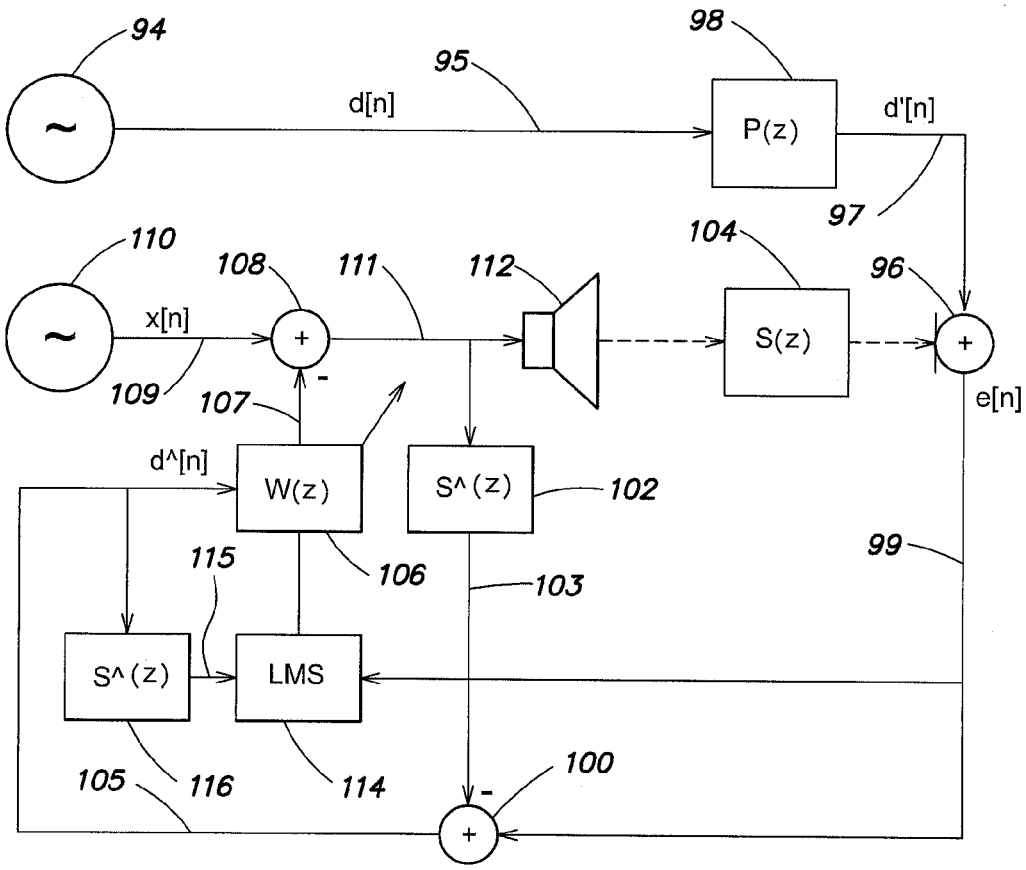
FIG. 9 is a block diagram illustration of an active noise reduction system that uses a filtered-x least mean square (FxLMS) algorithm.

In some embodiments, the system shown in FIG. 8 may be enhanced with an adaptation algorithm as illustrated in FIG. 9. Referring to FIG. 9, the filter 106 is a controllable filter controlled by an adaptation control unit 114. The adaptation control unit 114 receives a signal on line 115 from a filter 116, and the error signal e[n] on the line 99 from the error microphone 96. The filter 116 provides the signal on the line 115 by filtering the signal d^[n] on the line 105. The filter 116 has substantially the same transfer characteristic as the filter 102; i.e., the transfer characteristic S^(z). The controllable filter 102 and the control unit 114 together form an adaptive filter that may use, for example, a Least Mean Square (LMS) algorithm or a Filtered-x Least Mean Square (FxLMS) algorithm for adapting the transfer characteristic. Other algorithms, however, such as a Filtered-e LMS algorithm or the like may also be used for the adaptation.

Feedback ANC systems like those shown in FIGS. 8 and 9 estimate the pure noise signal d'[n], and input the estimated noise signal d^[n] into an ANC filter (e.g., the filter 106). The transfer characteristic S(z) of the acoustical secondary path 104 from the speaker 112 to the error microphone 96 is estimated to estimate the pure noise signal d'[n]. The estimated transfer characteristic S^(z) of the secondary path 104 is used in the filter 102 to electrically filter the signal supplied on the line 111 to the speaker 112. The estimated noise signal d^[n] is provided by subtracting the signal output of filter 102 from the error signal e[n]. The estimated noise signal d^[n] is approximately the same as the actual pure noise signal d'[n] when, for example, the estimated secondary path S^(z) is approximately the same as the actual secondary path S(z). The estimated noise signal d^[n] is filtered by the (ANC) filter 106 with the transfer characteristic W(z), where $$W(z)=P(z)/S(z),$$

and subtracted from the source signal x[n]. Signal e[n] may be expressed as follows:

$$e[n]=d[n]\cdot P(z)+x[n]\cdot S(z)-\hat{d}[n]\cdot(P(z)/\hat{S}(z))\cdot S(z)=x[n]\cdot S(z)$$

if, and only if S^(z)=S(z) and as such d^[n]=d'[n]. The estimated noise signal d^[n] may be expressed as follows:

$$\begin{aligned}\hat{d}[n] &= e[n]-(x[n]-d'[n]\cdot(P(z)/\hat{S}(z))\cdot\hat{S}(z))\\ &= d'[n]\cdot P(z)\\ &= d[n] \text{ if, and only if } \hat{S}(z)\\ &= S(z).\end{aligned}$$

Accordingly, the estimated noise signal d^[n] models the actual noise signal d[n].

Closed-loop systems such as the ones described above may decrease an unwanted reduction of a source signal by subtracting an estimated noise signal from the source signal before the source signal is supplied to the speaker. In open-loop systems, on the other hand, an error signal is fed through a special filter in which the error signal is low-pass filtered (e.g., below 1 kHz) and gain controlled to achieve a moderate loop gain for stability, and phase adapted (e.g., inverted) in order to achieve a certain noise reducing effect. Open-loop systems therefore are less complex than close-loop systems. An open-loop system, however, may cause the desired signal to be reduced.

Figure 10:
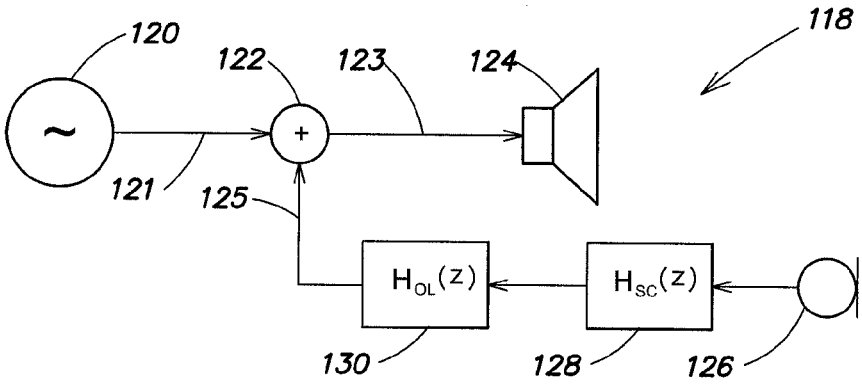
FIG. 10 is a block diagram illustration of an active noise reduction system having an open-loop structure.

FIG. 10 is a schematic illustration of an open-loop ANC system 118. A signal source 120 provides a source signal (e.g., a music signal) on line 121 to an adder 122. The adder 122 provides an output signal on line 123 via appropriate signal processing circuitry (not shown) to a speaker 124. The adder 122 also receives an error signal via line 125, which is generated by serially filtering an output signal provided by an error microphone 126 with a filter 128 and a filter 130. The filter 130 has a transfer characteristic $H_{OL}(z)$, and the filter 128 has a transfer characteristic $H_{SC}(z)$. The transfer characteristic $H_{OL}(z)$ is the characteristic of an open loop system, and the transfer characteristic $H_{SC}(z)$ is the characteristic for compensating for the difference between the virtual position and the actual position of the error microphone 126.

A typical closed loop ANC system exhibits its best performance when the error microphone is mounted as close to the ear as possible (e.g., in the ear). Locating the error microphone in the ear, however, may be inconvenient for the listener, and may deteriorate the sound perceived by the listener. Alternatively, locating the error microphone outside the ear may reduce the quality of the ANC system. Some known ANC systems therefore have modified the mechanical structure, for example, to provide a compact enclosure between the speaker and the error microphone. The compact enclosure is used such that the microphone ideally is not disturbed by the way a user wears the headphone or by different users. Although such mechanical modifications are able to solve the stability problem to a certain extent, they still may distort the acoustical performance because they are located between the speaker and the listener's ear.

The present system may overcome the aforesaid disadvantages using analog and/or digital signal processing to allow, on one hand, the error microphone to be located distant from the ear and, on the other hand, to provide substantially constant and stable performance. The present system may overcome the stability problem by placing the error microphone behind the speaker; e.g., between the ear-cup and the speaker. This position provides a defined enclosure which does not distort the acoustical performance of the speaker. In order to overcome decreased ANC performance due to the location of the error microphone, the present system utilizes a "virtual microphone" located directly in the ear of the user. The term "virtual microphone" describes how the microphone is actually arranged at one location but appears to be located at another "virtual" location using signal filtering. The following examples are based on digital signal processing so that each signal and transfer characteristic used may be in a discrete time and spectral domain (n, z). For analog processing, signals and transfer characteristics in the continuous time and spectral domain (t, s) are used such that n may be substituted by t and z may be substituted by s in the following examples.

Referring again to FIG. 6, the ideal transfer characteristic $H_{SE}(z)$ of the "desired" signal path 84 from the speaker 66 to the ear 44 is assessed, and the actual transfer characteristic $H_{SM}(z)$ on the "real" signal path 70 from the speaker 66 to the error microphone 68 is determined to create a "virtual" error microphone. The filter characteristic W(z) is set to $W(z)=1/Hs_{SE}(z)$ to determine the filter characteristic W(z) which provides an ideal sound reception and optimum noise cancellation at the virtual microphone position. The total signal $x[n]\cdot H_{SE}(z)$ received by the virtual error microphone may be expressed as follows:

$$N[n] + \left(x[n] - \left(\frac{N[n]}{H_{SE}(z)}\right)\right) * H_{SE}(z) = x[n] * H_{SE}(z).$$

The estimated noise signal N[n] that forms the input signal of the ANC system may be expressed as follows:

$$\underbrace{\left(x[n] - \frac{N[n]}{H_{SE}(z)}\right) * H_{SM}(z) + N[n]}_{e[n]} + \left(\frac{N[n]}{H_{SE}(z)} - x[n]\right) * H_{SM}(z) = N[n].$$

Relatively high (e.g., optimal) noise suppression is achieved therefore when the estimated noise signal N[n] at the virtual position is substantially the same as the actual noise in the listener's ear.

The quality of the noise suppression algorithm depends at least in part on how accurately the secondary path S(z) having, for example, the transfer characteristic $H_{SM}(z)$ is determined. The system therefore may adapt to changes in the secondary path S(z) in order to maintain the accuracy of the secondary path S(z) determination. Such adaptations, however, may consume additional time and increase signal processing costs. The system therefore may keep the secondary path S(z) essentially stable (i.e., maintain a substantially constant transfer characteristic $H_{SM}(z)$) in order to reduce signal processing complexity.

The error microphone is arranged in a position where different modes of operation do not create significant fluctuations of the transfer function $H_{SM}(z)$ to maintain a stable secondary path S(z). The error microphone, for example, may be arranged within the earphone cavity (see FIG. 4), which is relatively insensitive to fluctuations. Additional filtering (e.g., allpass filtering) that uses minimal signal processing is provided to compensate for the relatively large distance between the error microphone and the ear. The additional signal processing used for realizing the transfer characteristics $1/H_{SE}(z)$ and $H_{SM}(z)$ can be provided by digital and/or analog circuitry (e.g., programmable RC filters using operational amplifiers).

The performance of an ANC system employing a virtual microphone essentially depends on the difference between the noise signals at the positions of the actual error microphone and the virtual microphone (e.g., the ear). For an estimation of the performance of such ANC system in the continuous spectral domain, a so-called Maximum Square Coherence (MSC) Function $C_{ij}(\omega)$ is used, which may be expressed as follows:

$$C_{ij}(\omega) = |\Gamma_{ij}(\omega)|^2 = \frac{|P_{X_i X_j}(\omega)|^2}{P_{X_i X_i}(\omega) * P_{X_j X_j}(\omega)}$$

where $P_{XiXi}(\omega)$ and $P_{XjXj}(\omega)$ are the Auto Power Density Spectra, and $P_{XiXj}(\omega)$ is the Cross Power Density Spectrum of signals $X_i$ and $X_j$. $G_{ij}(\omega)$ is the Complex Coherent Function of two microphones i and j. The Complex Coherent Function $G_{ij}(\omega)$ basically depends on the local noise field. A diffuse noise field is assumed for the worst case considerations made below. Such field can be expressed as follows:

$$\Gamma_{x_i x_j}(\omega) = si\left(\frac{2*\pi*f*d_{ij}}{c}\right) * e^{-j*\frac{2*\pi*f*d_{ij}}{c}}$$

$$\text{with } i, j \in [1, \ldots, M]$$

where f is the frequency in Hertz (Hz), $d_{ij}$ is the distance between microphones i and j in meters (m), c is sound velocity in air at room temperature (c=340 [m/s]), and M is the number of microphones (e.g., 2). The SI function may be expressed as follows:

$$si(x) = \frac{\sin(x)}{x}.$$

The distance $d_{ij}$ may be expressed as follows:

$$d_{ij} = \begin{pmatrix} 0 & d & \ldots & (M-1)*d \\ -d & 0 & \ldots & (M-2)*d \\ \vdots & \vdots & \ddots & \vdots \\ -(M-1)*d & -(M-2)*d & \ldots & 0 \end{pmatrix}.$$

The MSC function is, similar to the correlation coefficient in the time domain, the degree of the linear interdependency of the two processes. The MSC function $C_{ij}(\omega)$ is at its maximum 1 where, for example, the signals $x_i(t)$ and $x_j(t)$ at the respective frequencies ω are correlated. The MSC function $C_{ij}(\omega)$ is at its minimum 0 where, for example, the signals $x_i(t)$ and $x_j(t)$ are uncorrelated. Accordingly:

$$1 \geq C_{ij}(\omega) \geq 0.$$

Figure 11:
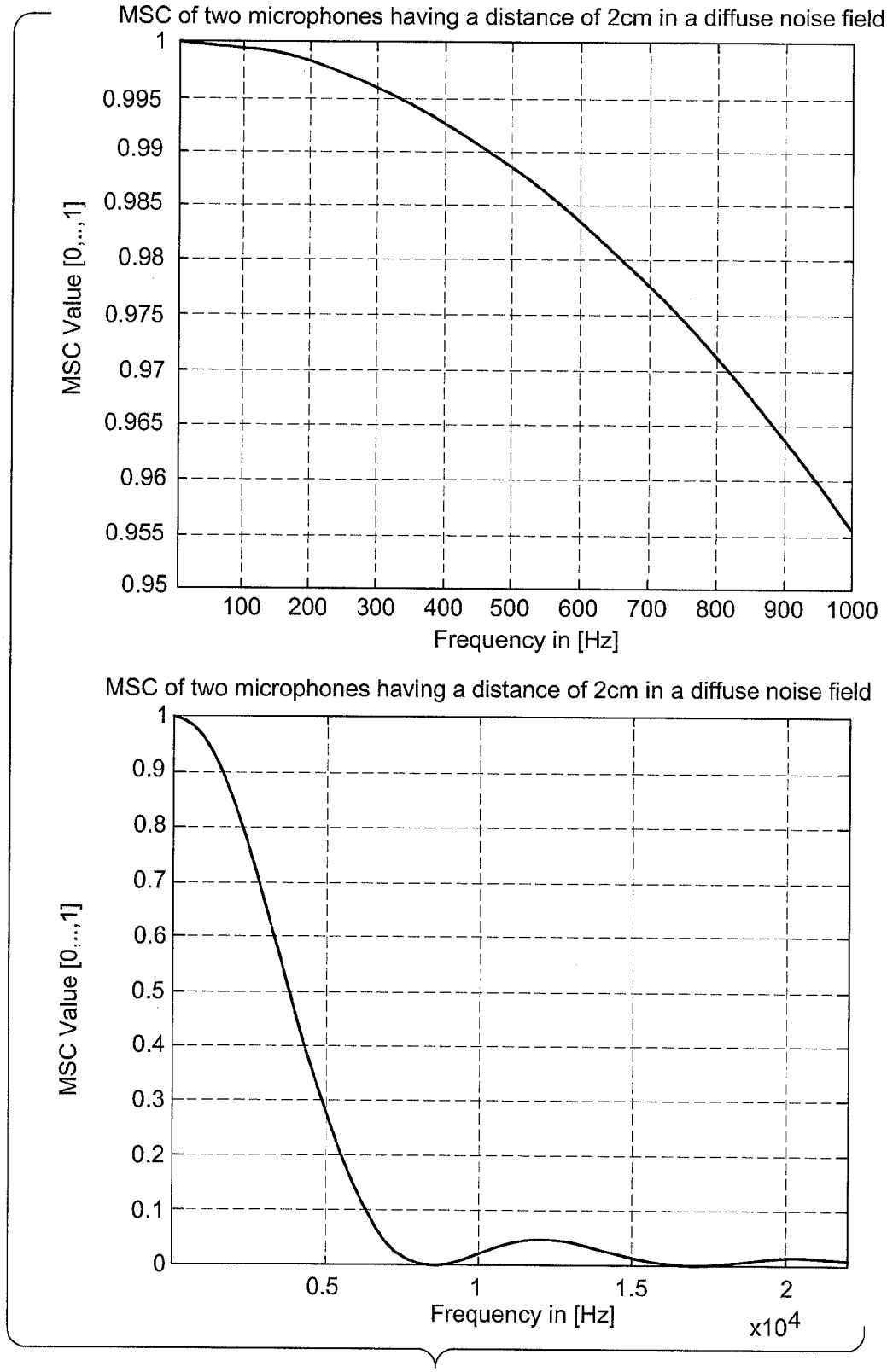
FIG. 11 is a diagram illustrating an MSC function in a diffuse noise field.

The MSC function describes the error that occurs when the signal from microphone j is linearly estimated based on the signal from microphone i. If the distance is d=2 cm in a diffuse noise field, the MSC function may behave as illustrated in FIG. 11. The maximum ANC damping $D_{ij}(\omega)$ may be derived from MSC function $C_{ij}(\omega)$ as follows:

$$D_{ij}(\omega)=20\cdot\log10(1-C_{ij}(\omega)) \text{ in [dB]}.$$

Figure 12:
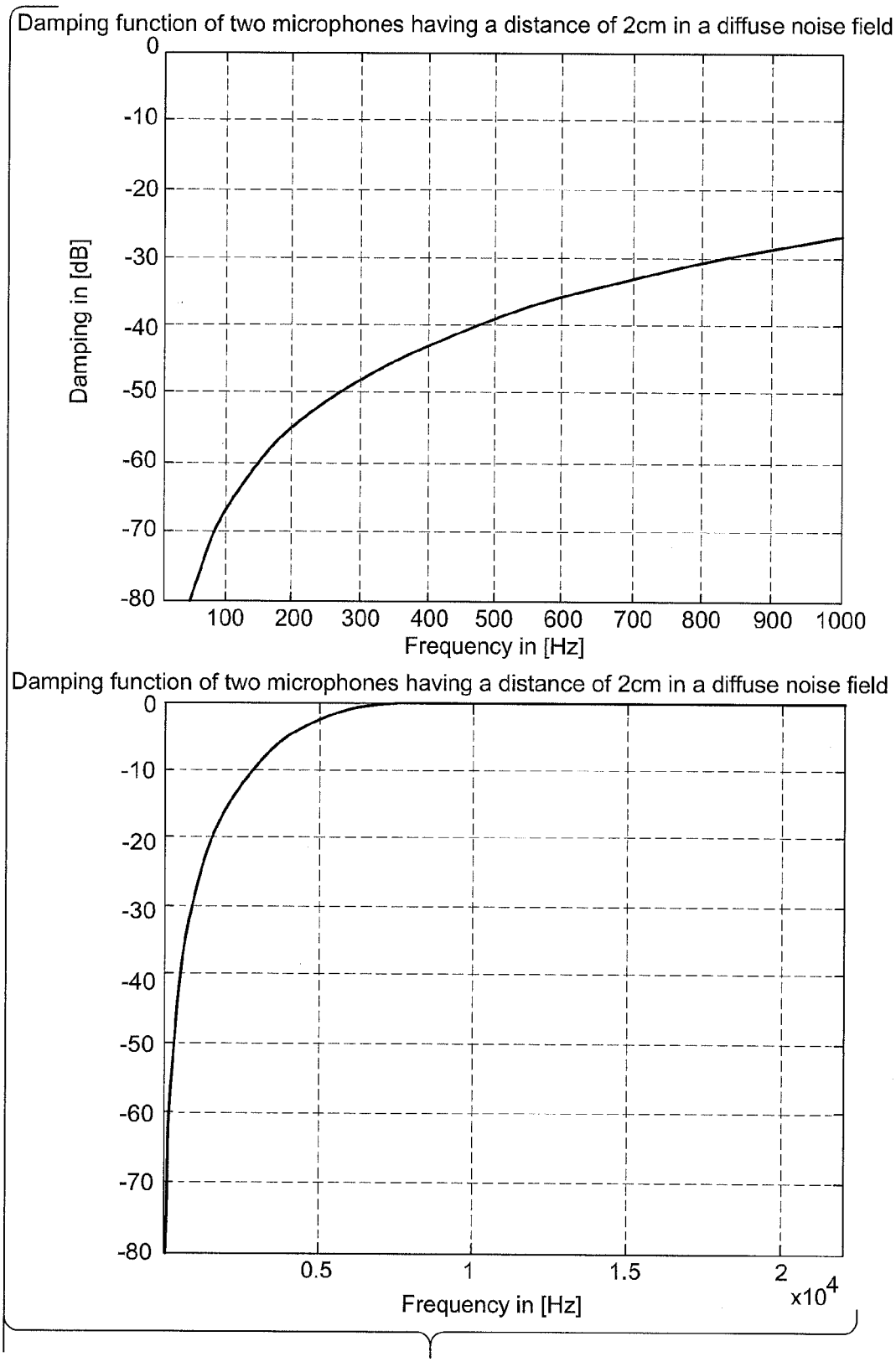
FIG. 12 is a diagram illustrating a damping function in a diffuse noise field.

FIG. 12 illustrates the damping function $D_{ij}(\omega)$ in decibels (dB) occurring in a diffuse noise field with a microphone distance of 2 cm. As can be seen from FIG. 12, theoretically a noise suppression (e.g., damping) $D_{ij}(\omega)$=27 dB can be achieved at a frequency of 1 kHz in a diffuse noise field with a microphone distance of 2 cm, which is amply sufficient.

Although various examples to realize the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. Such modifications to the inventive concept are intended to be covered by the appended claims.

What is claimed is:

1. An active noise reduction system, comprising:

an earphone to be acoustically coupled to an ear of a user, the earphone comprising a cupped housing having an aperture;

a transmitting transducer that converts a first electrical signal into a first acoustical signal, and that radiates the first acoustical signal to the ear, where the transmitting transducer is arranged at the aperture of the cupped housing thereby defining an earphone cavity; and a receiving transducer that converts a second acoustical signal into a second electrical signal, where the receiving transducer is arranged within the earphone cavity;

a first acoustical path that extends from the transmitting transducer to the ear, and that has a first transfer function characteristic indicative of acoustics of the first acoustical path;

a second acoustical path that extends from the transmitting transducer to the receiving transducer, and that has a second transfer function characteristic indicative of acoustics of the second acoustical path; and a control unit electrically connected to the receiving transducer and the transmitting transducer, and that compensates for ambient noise by generating a noise reducing electrical signal that is supplied to the transmitting transducer;

where the noise reducing electrical signal is derived from a filtered electrical signal, which is provided by filtering the second electrical signal with a third transfer function characteristic; and where the second and the third transfer function characteristics together model the first transfer function characteristic, where the filtered electrical signal is indicative of audio at a virtual receiving transducer position located acoustically downstream of the transmitting transducer.

2. The system of claim 1, where the noise reducing electrical signal and the ambient noise signal have substantially equal amplitudes, and where phase of the noise reducing electrical signal is substantially opposite to phase of the ambient noise signal.

3. The system of claim 1, further comprising a signal source that provides a source signal, where the first electrical signal is derived from the source signal and the noise reducing electrical signal.

4. The system of claim 3, where the control unit comprises a first filter that provides a first filtered signal, and that has a fourth transfer function characteristic that is substantially inverse to the first transfer function characteristic.

5. The system of claim 4, where the control unit further comprises a second filter that provides a second filtered signal, and that has a fifth transfer function characteristic that is substantially equal to the second transfer function characteristic.

6. The system of claim 5, where the control unit further comprises:

a subtracting unit connected to the first filter and the signal source, where the subtracting unit subtracts the first filtered signal from the source signal to generate the first electrical signal, and where first electrical signal is inverted and supplied to the second filter; and a summing unit connected to the second filter and the receiving transducer, where the summing unit adds the second filtered signal to the second electrical signal to generate an electrical noise signal that is supplied to the first filter.

7. The system of claim 5, where at least one of the first and second filters is an adaptive filter.

8. The system of claim 1, where the control unit comprises at least one of analog and digital circuitry.

9. The system of claim 1, where the transmitting transducer is mounted to a hermetically sealed volume.

10. The system of claim 9, where the transmitting transducer is hermetically mounted to the housing to form the hermetically sealed volume.

11. A system for actively reducing noise at a listening point, comprising:

an earphone housing having an earphone aperture and an inner earphone cavity;

a transmitting transducer positioned at the earphone aperture, where the transmitting transducer converts a first electric signal into a first acoustic signal, and radiates the first acoustic signal along a first acoustic path having a first transfer function characteristic indicative of acoustics of the first acoustical path and along a second acoustic path having a second transfer function characteristic indicative of acoustics of the second acoustical path;

a receiving transducer positioned within the earphone cavity, where the receiving transducer converts the first acoustic signal and ambient noise into a second electrical signal; and a controller that compensates for the ambient noise by providing a noise reducing electrical signal to the transmitting transducer, where the noise reducing electrical signal is derived from a filtered electrical signal that is provided by filtering the second electrical signal with a third transfer function characteristic;

where the first acoustic path extends from the transmitting transducer to the listening point, where the second acoustic path extends from the transmitting transducer to the receiving transducer, and where the second and the third transfer function characteristics together model the first transfer function characteristic, where the filtered electrical signal is indicative of audio at a virtual receiving transducer position located acoustically downstream of the transmitting transducer.

12. The system of claim 11, where the noise reducing electrical signal and the ambient noise have substantially equal amplitudes, and where phase of the noise reducing electrical signal is substantially opposite to phase of the ambient noise.

13. The system of claim 11, further comprising a signal source that provides a source signal, where the first electrical signal is derived from the source signal and the noise reducing electrical signal.

14. The system of claim 13, where the controller comprises a first filter having a fourth transfer function characteristic that is substantially inverse to the first transfer function characteristic, where the first filter filters a third electric signal derived from the filtered electrical signal to provide a first filtered signal, and where the first electrical signal is derived from the first filtered signal.

15. The system of claim 14, where the controller further comprises a second filter having a fifth transfer function characteristic that is substantially equal to the second transfer function characteristic, where the second filter filters the first electrical signal to provide a second filtered signal, and where the third electric signal is derived from the second filtered signal.

16. The system of claim 15, where the controller further comprises:

a subtractor connected to the first filter and the signal source, where the subtractor subtracts the first filtered signal from the source signal to generate the first electrical signal, and where first electrical signal is inverted and supplied to the second filter; and an adder connected to the second filter and the receiving transducer, where the adder adds the second filtered signal to second electrical signal to generate an electrical noise signal that is supplied to the first filter.

17. The system of claim 15, where at least one of the first and second filters is an adaptive filter.

18. The system of claim 11, where the transmitting transducer is mounted to a hermetically sealed volume.

19. The system of claim 18, where the transmitting transducer is hermetically mounted to the housing to form the hermetically sealed volume.

* * * * *